US005136846A

United States Patent [19]

Arii et al.

[11] Patent Number: 5,136,846

[45] Date of Patent: Aug. 11, 1992

[54] HYDRAULIC CIRCUIT WITH A SWITCHOVER VALVE FOR SWITCHING BETWEEN A HIGH AND A LOW-PRESSURE RELIEF

[75] Inventors: Kazuyoshi Arii; Masaru Kumatani, both of Osaka, Japan

[73] Assignee: Kubota, Ltd., Osaka, Japan

[21] Appl. No.: 495,270

[22] Filed: Mar. 16, 1990

[30] Foreign Application Priority Data

Apr. 18, 1989 [JP] Japan ..... 1-99072

[51] Int. Cl.[5] ..... F16D 31/02

[52] U.S. Cl. ..... 60/468; 60/494

[58] Field of Search ..... 60/420, 428, 468, 486, 60/494; 417/286, 287, 288, 428

[56] References Cited

U.S. PATENT DOCUMENTS

| | | | |
|---|---|---|---|
| 3,716,308 | 2/1973 | Kobald | 60/420 |
| 3,910,044 | 10/1975 | Symmank | 60/420 |
| 3,916,624 | 11/1975 | Machens et al. | 60/428 |
| 3,922,855 | 12/1975 | Bridwell . | |
| 4,558,629 | 12/1985 | Unger et al. | 60/486 |
| 4,768,339 | 9/1988 | Aoyagi et al. | 60/428 |
| 4,961,371 | 10/1990 | Takashima | 91/530 |
| 4,986,075 | 1/1991 | Shimoie | 60/468 |

FOREIGN PATENT DOCUMENTS

| | | | |
|---|---|---|---|
| 2329880 | 5/1977 | France . | |
| 55-47003 | 4/1980 | Japan | 60/428 |
| 59-65607 | 4/1984 | Japan | 60/428 |
| 62-31166 | 2/1987 | Japan . | |

*Primary Examiner*—Edward K. Look
*Assistant Examiner*—F. Daniel Lopez
*Attorney, Agent, or Firm*—Gifford, Groh, Sprinkle, Patmore and Anderson

[57] ABSTRACT

A hydraulic circuit, for use with i.e. a backhoe implement of a work vehicle. The circuit includes an engine, first through third pumps driven by the engine and a plurality of actuators. The invention is characterized by a relief pressure switchover device for selectively providing a first mode for realizing a low relief pressure in the first and second feed oil passages and a second mode for realizing a high relief pressure in the same and a relief pressure control device for causing the relief pressure switchover device to automatically provide the first mode when the third pump is loaded and causing the switchover device to automatically provide the second mode when the third pump is unloaded.

3 Claims, 2 Drawing Sheets

HYDRAULIC CIRCUIT WITH A SWITCHOVER VALVE FOR SWITCHING BETWEEN A HIGH AND A LOW-PRESSURE RELIEF

BACKGROUND OF THE INVENTION

1. Field of the Invention

The present invention relates to a hydraulic circuit for a backhoe implement of a work vehicle, and more particularly, to a hydraulic circuit of the above type having a plurality of pumps driven by a common engine and a plurality of actuators.

2. Description of the Related Art

A hydraulic circuit of the above-described type is known from a Japanese laid-open utility model gazette No. 62-31166, for example. This circuit includes first through third pumps respectively connected to corresponding actuators, and all these three pumps are driven by a single engine. For this reason, magnitude of the engine output is so designed as to avoid an engine stop even if a sum pressure of oil fed from all the pumps reaches a relief pressure. During a vehicle run or a work a such as, excavating work, the engine receives a large load for the first and second pumps, while the third pump for e.g. swivelling remains idle, that is unloaded. Accordingly, the actual total load affecting the engine is smaller than the above-described, predetermined tolerable load, which means that part of the engine output remains unused during the vehicle run or the work. This is undesirable with view to the maximum efficient use of the engine output.

One conceivable method to improve the efficiency is to provide a manually operable, relief pressure switchover means for switching the relief pressure between a high state and a low state to be fed to a first feed oil passage connected to the first pump and a second feed oil passage connected to the second pump. However, whether the relief pressure switchover means can function properly or not depends on whether the user operates the same properly or not. This can be difficult when the user's attention is diverted for carrying out various tasks in a short time period. With the pressure being erroneously set to low, the user will fail to utilize the engine output fully for the desired vehicle run or the work, just as the case having no such relief pressure switchover means at all. In the opposite case, the user will suffer frequent engine stops.

The object of the invention becomes now clear. The invention intends to provide a hydraulic circuit which permits full use of the engine output all the time and which permits a proper switching of the relief pressure in an automatic fashion.

SUMMARY OF THE INVENTION

For accomplishing the above-specified object, in a hydraulic circuit, for use with a backhoe implement of a work vehicle, the hydraulic circuit according to the invention comprises: a) an engine; b) first through third pumps driven by the engine, the first pump being connected via a first feed oil passage to one of a pair of right and left propelling control valves and a first control means, the second pump being connected via a second feed oil passage to the other of the propelling control valve pair and a second control means, the third pump being connected to a swivel control valve and a third control means, c) a plurality of actuator means respectively connected to the right and left propelling control valves, the swivel control valve and the first through third control means; d) a relief pressure switchover means for selectively providing a first mode for realizing a low relief pressure in the first and second feed oil passages and a second mode for realizing a high relief pressure in the same; and e) a relief pressure control means for causing the relief pressure switchover means to automatically provide the first mode when the third pump is loaded and causing the switchover means to automatically provide the second mode when the third pump is unloading.

With the above-defined characterizing construction of the invention, when the third pump is unloading, the relief pressure control means causes the relief pressure switchover means to automatically provide the second mode for realizing a high relief pressure in the first and second feed oil passages. Accordingly, even if the entire output of the engine, which is designed sufficient to drive all the pumps at the same time, is used for driving the actuators connected to the first and second pumps, the combined pressure from these pumps will not exceed the relief pressure which has been set high by the switchover means, whereby the entire pump pressure can be used for driving the corresponding actuators. Conversely, when the third pump is loaded, the relief pressure control means causes the relief pressure switchover means to automatically provide the first mode for realizing a low relief pressure in the first and second feed oil passages. Accordingly, the engine can drive all the actuators connected to the first through third pumps at the same time without being stopped by the sum loads from the actuators.

With the combination of the relief pressure switchover means and the relief pressure control means taught by the invention, the engine output can be fully utilized not only when the actuators are driven by all the pumps but also when the actuators are driven by the first and second pumps alone, whereby a vehicle run and a work such as an excavating operation can be carried out in a powerful and efficient manner.

Further, with the automatic relief pressure switchover function, the user can benefit the maximum utilization of the engine output in a carefree fashion, which effect will be appreciated in particular when the user can not afford to pay proper attention to the relief pressure condition as having to carry out various kinds of tasks in a short period of time.

Further and other objects, features and effects of the invention will become more apparent from the following more detailed description of the embodiments of the invention with reference to the accompanying drawings.

BRIEF DESCRIPTION OF THE DRAWINGS

Accompanying drawings illustrate one preferred embodiment of a hydraulic circuit relating to the invention; in which.

DESCRIPTION OF THE PREFERRED EMBODIMENTS

Preferred embodiments of the invention will now be described specifically with reference to the accompanying drawings.

Figure 1:
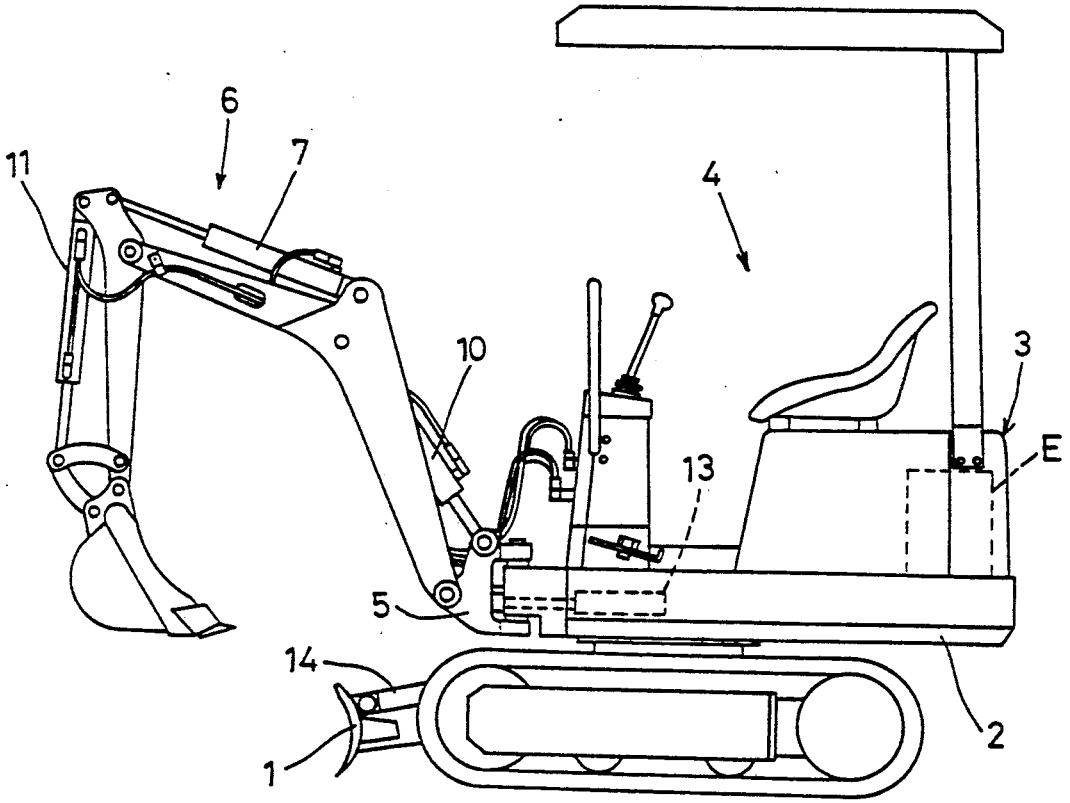
FIG. 1 is a side view showing a dozer-equipped backhoe work vehicle.

As shown in FIG. 1, a dozer-equipped backhoe vehicle includes a crawler-propelled vehicle body equipped with a dozer plate 1 and a swivel deck 2, a power unit 3, a driver's section 4 mounted on the swivel deck 2 and a backhoe implement 6 pivotably attached to a front portion of the vehicle body through a swing bracket 5.

For operating the dozer plate 1, the swivel deck 2, an unillustrated propelling unit and also the backhoe implement 6, the power unit 3 includes first through third pumps P1, P2 and P3 driven by a same engine E and a hydraulic circuit to be described next with reference to FIG. 2.

Figure 2:
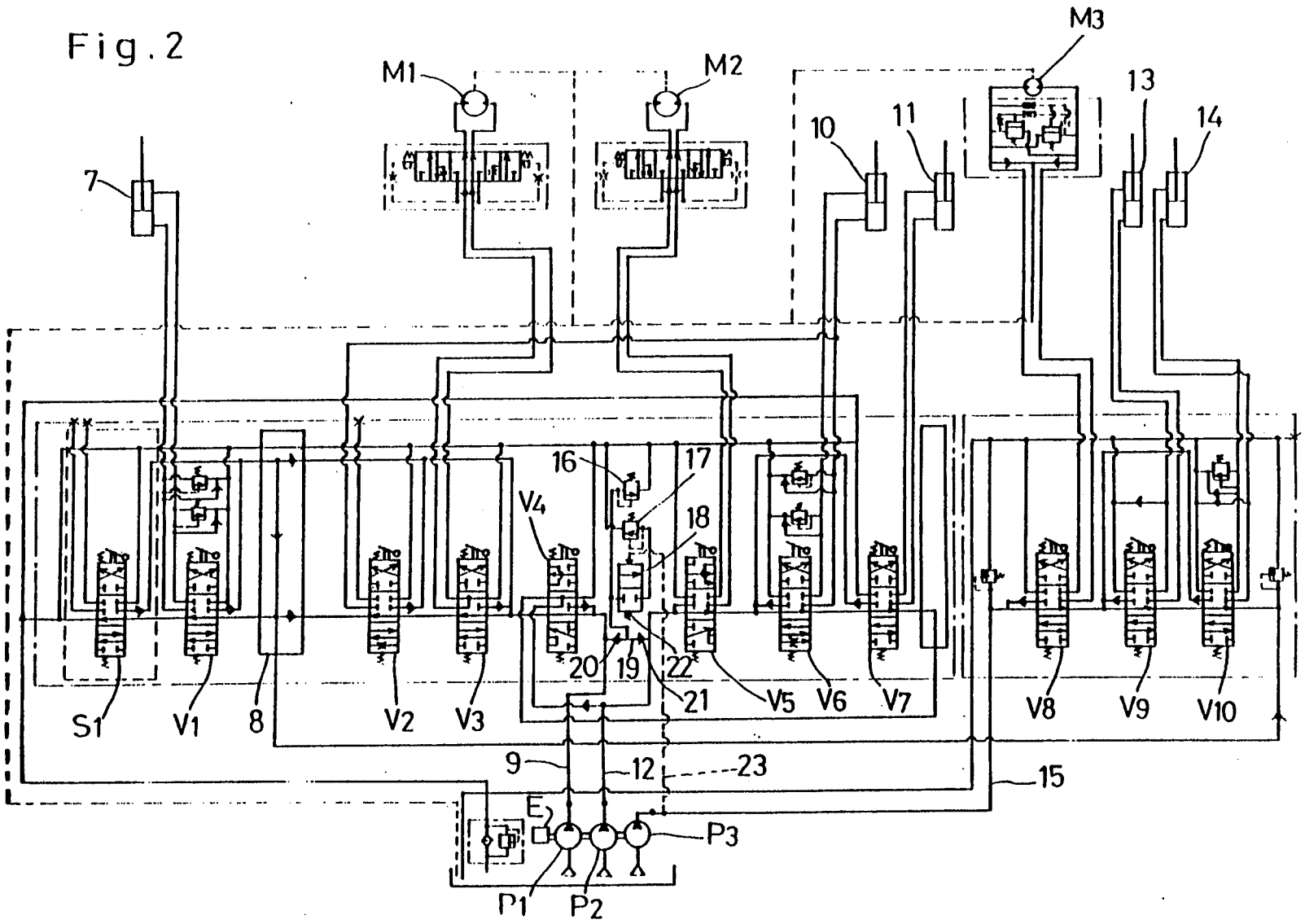
FIG. 2 is a diagram of the invention's hydraulic circuit.

Referring to FIG. 2, this hydraulic circuit functions to control operations of various actuator means: a pair of right and left crawler-propelling motors M1, M2, a swivel motor M3 for pivoting the swivel deck 2, an arm cylinder 7, a boom cylinder 10, a bucket cylinder 11, a swing cylinder 13 and a dozer cylinder 14.

That is, the circuit includes a center-bypass type multiple valve construction consisting of a service port control valve S1, an arm control valve V1 for the arm cylnder 7, a converging spacer 8, a converging valve V2 for the boom, a propelling control valve V3 for one of the right and left propelling motors M1 and M2 and a converging valve V4. This multiple valve construction is connected via a first feed oil passage 9 to the first pump P1, with the valves S1, V1 and V2 being connected in parallel relative to each other with the first pump P1. The arm control valve V1 connected to the first feed oil passage 9 will be referred to as a first control means. Further, the converging valve V2 for the boom is operatively connected with the oil passage extending from a boom control valve V6 (to be described later) to the boom cylinder 10, so that combined power of the first and second pumps P1 and P2 can be used for quickly lifting up the boom. The hydraulic circuit includes a further center-bypass type multiple valve construction consisting of a propelling control valve V5 for the other one of the propelling motors M1 and M2, the aforementioned boom control valve V6 for the boom cylinder 10, and of a bucket control valve V7 for the bucket cylinder 11. This further multiple valve construction is connected via a second feed oil passage 12 to the second pump P2. The boom control valve V6 connected to the second feed oil passage 12 and the bucket control valve V7 will be referred to as a second control means. The hydraulic circuit includes a further center-bypass type multiple valve construction consisting of a swivel control valve V8 for the swivel motor M3, a swing control valve V9 for the swing cylinder 13 and the dozer control valve V10 for the dozer cylinder 14. This multiple valve construction is connected via a third feed oil passage 15 to the third pump P3. The swing control valve V9 and the dozer control valve V10 will be referred to as a third control means.

In the circuit, there is also provided a relief oil passage 19 including a high-pressure relief valve 16, a low-pressure relief valve 17, a switch valve 18 and a pair of check valves 20 and 21. This relief oil passage 19 is connected to the first and second feed oil passages 9 and 12 so that the one check valve 20 checks reverse flow to the first feed oil passage 9 while the other check valve 21 checks reverse flow to the second feed oil passage 12. When the switch valve 18 is opened, the low-pressure relief valve 17 overrides the high-pressure relief valve 16 as the former becomes connected with the check valves 20 and 21, thereby realizing a low relief pressure in the relief oil passage 19 as a first mode. Conversely, when the switch valve 18 is closed, the high-pressure relief valve 16 overrides the low-pressure relief valve 17 as the latter becomes disconnected with the check valves 20 and 21, thereby realizing a high relief pressure in the relief oil passage 19 as a second mode. In short, when the switch valve 18 is opened, the low relief pressure is provided to the first and second feed oil passages 9 and 12. Whereas, when the switch valve 18 is closed, the high relief pressure is provided to the first and second feed oil passages 9 and 15. Further, this switch valve 18 is urged for closing by means of a spring 22 and is adapted to receive a pilot pressure via a pilot oil passage 23 from the third feed oil passage 15. Consequently, the switch valve 18 is automatically switched over between a first mode in which the third pump P3 is loaded to drive the actuators and a second mode in which the pump P3 is unloading not to drive the same. More particularly, when the third pump P3 is in the loaded condition, the load causes the pressure inside the third feed oil passage 15 to exceed a predetermined value, which excess pressure provides a pilot pressure to the pilot oil passage 23. And, this pilot pressure switches over the switch valve 18 to the opened state. Thereafter, when the third pump P3 is brought into the unloaded condition, the absence of the load causes the pressure inside the third feed oil passage 15 to fall short of the predetermined value, thus eliminating the excess pressure to the pilot oil passage 23. With resultant elimination of pilot pressure, the switch valve 18 is automatically switched over to the closed state by the urging force of the spring 22.

To summarize the above functions, when the third pump P3 is loaded for driving the actuators, the relief pressure for the first and second feed oil passages 9 and 12 is automatically rendered low. Therefore, the engine E can drive all the first through third pumps P1, P2 and P3 simultaneously without being stopped even when these pumps P1, P2 and P3 receive loads from driving the corresponding actuators. On the other hand, when the third pump P3 is unloaded, the relief pressure for the first and second feed oil passages 9 and 12 is automatically rendered high. Therefore, the entire engine output can be used for driving the first and second pump P1 and P2 more powerfully than all the pumps P1, P2 and P3 are driven simultaneously.

ALTERNATE EMBODIMENTS

In the above embodiment, the first and second oil passages 9 and 12 co-utilize the two high-pressure and low-pressure relief valves and the one switch valve. Instead, it is conceivable for the invention's construction to include a variable relief valve or means for selectively connecting the relief oil passage to the respective feed oil passages so that the former provides a switchable relief pressure to the latter. Therefore, in this invention, these various means are generically referred to as a relief pressure switchover means 18 for the first and second feed oil passage 9 and 12. Also, the open state of the switch valve 18 is referred to as the first mode while the closed state of the same is referred to as the second mode, respectively.

Moreover, in place of the pilot oil passage 23, it is also conceivable to employ an automatic control means for mechanically or electrically coupling the control valves with the relief pressure switchover means so that the condition of the third pump is detected based on the positions of the control valves and the switch valve and the variable relief valve are switched over based on this detection. Therefore, these means are generically referred to as a relief pressure control means 23.

Furthermore, in the previous embodiment, the combinations between the actuator means as the first through third control means and the first through third pumps P1, P2 and P3 are specifically predetermined. It is noted however that these combinations can vary through designing to suit a particular application intended.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Further, although reference marks and numerals are provided in the appended claims in order to facilitate reference to the accompanying drawings, it is understood that these marks and numerals are not to limit the scope of the invention to the constructions illustrated in these drawings.

What is claimed is:

1. A hydraulic circuit for use with a backhoe implement of a work vehicle, said hydraulic circuit comprising:

an engine;

first, second, and third pumps driven by said engine, said first pump being connected to a first feed oil passage, said first feed oil passage in turn being connected to one of a pair of right and left propelling control valves and a first control means, said second pump being connected to a second feed oil passage, said second feed oil passage in turn being connected to the other of said pair of right and left propelling control valves and a second control means, said third pump being connected to a swivel control valve and a third control means, a plurality of actuator means respectively connected to said right and left propelling control valves, said swivel control valve and said first, second and third control means;

a high pressure relief valve connected to said first and second feed oil passages, said high pressure relief valve relieving pressure at a predetermined fixed pressure;

a low pressure relief valve; and a switch valve connected between said low pressure relief valve and said first and second feed oil passages, said switch valve being positionable in a first state and a second state, said switch valve being automatically positionable in said first state, in response to said third pump being unloaded to disconnect said low pressure relief valve from said first and second feed oil passages, said switch valve being automatically positionable in said second state, in response to said third pump being loaded to connect said first and second feed oil lines to said low pressure relief valve to unload said first and second pumps.

2. The hydraulic circuit as defined in claim 1, wherein said first control means includes an arm control valve, said second control means includes a boom control valve and a bucket control valve, respectively.

3. The hydraulic circuit as defined in claim 2, further comprising a third control means including a swing control valve and a dozer control valve.

* * * * *